US009070983B2

(12) United States Patent
Odoko et al.

(10) Patent No.: US 9,070,983 B2
(45) Date of Patent: Jun. 30, 2015

(54) WIRELESS COMMUNICATION SYSTEM

(75) Inventors: Kazuhiro Odoko, Shizuoka-ken (JP); Hiroki Mochizuki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 325 days.

(21) Appl. No.: 13/553,960

(22) Filed: Jul. 20, 2012

(65) Prior Publication Data

US 2013/0027262 A1 Jan. 31, 2013

(30) Foreign Application Priority Data

Jul. 29, 2011 (JP) ..... 2011-166739

(51) Int. Cl.

| | |
|---|---|
| ***H01Q 13/00*** | (2006.01) |
| ***H01Q 9/04*** | (2006.01) |
| ***H01Q 13/20*** | (2006.01) |
| ***H01Q 23/00*** | (2006.01) |

(52) U.S. Cl.

CPC ..... *H01Q 13/203* (2013.01); *H01Q 23/00* (2013.01)

(58) Field of Classification Search

CPC ... H01Q 13/203; H01Q 13/20; H01Q 13/206; H04B 5/0018

See application file for complete search history.

(56) References Cited

U.S. PATENT DOCUMENTS

| | | | | |
|---|---|---|---|---|
| 5,621,420 | A * | 4/1997 | Benson | 343/791 |
| 6,177,911 | B1 * | 1/2001 | Yuda et al. | 343/792 |
| 6,429,830 | B2 * | 8/2002 | Noro et al. | 343/895 |
| 6,587,081 | B2 * | 7/2003 | Noro et al. | 343/895 |
| 7,053,845 | B1 * | 5/2006 | Holloway et al. | 343/725 |
| 2013/0027263 | A1 * | 1/2013 | Gocho et al. | 343/784 |
| 2013/0029615 | A1 * | 1/2013 | Gocho et al. | 455/90.2 |

FOREIGN PATENT DOCUMENTS

| | | |
|---|---|---|
| JP | 02-143816 | 6/1990 |
| JP | 09-232850 | 9/1997 |
| JP | 2005-236745 | 9/2005 |
| JP | 2007-336356 | 12/2007 |

OTHER PUBLICATIONS

First Office Action of Reasons for Rejection for Japanese Patent Application No. 2011-166739 Dated Jul. 23, 2013, 4 pgs.

* cited by examiner

*Primary Examiner* — Trinh Dinh

(74) *Attorney, Agent, or Firm* — Amin, Turocy & Watson, LLP

(57) ABSTRACT

A wireless communication system, comprises a tower-shaped antenna includes a leaky coaxial cable that leaks a radio wave and a reflective member that reflect the radio wave leaked from the leaky coaxial cable in the direction perpendicular to an axial direction of the leaky coaxial cable.

3 Claims, 5 Drawing Sheets

WIRELESS COMMUNICATION SYSTEM

CROSS-REFERENCE TO RELATED APPLICATION

This application is based upon and claims the benefit of priority from Japanese Patent Application No. 2011-166739, filed Jul. 29, 2011, the entire contents of which are incorporated herein by reference.

FIELD

Embodiments described herein relate to a wireless communication system using a leaky coaxial cable as an antenna.

BACKGROUND

By using a leaky coaxial cable as an antenna, a wireless LAN area so-called free-spot can be formed around the leaky coaxial cable.

DETAILED DESCRIPTION

According to one embodiment, a wireless communication system, comprises a tower-shaped antenna includes a leaky coaxial cable that leaks a radio wave and a reflective member that reflect the radio wave leaked from the leaky coaxial cable in the direction perpendicular to an axial direction of the leaky coaxial cable.

(1) The first embodiment will be illustrated with reference to the drawings.

Figure 1:
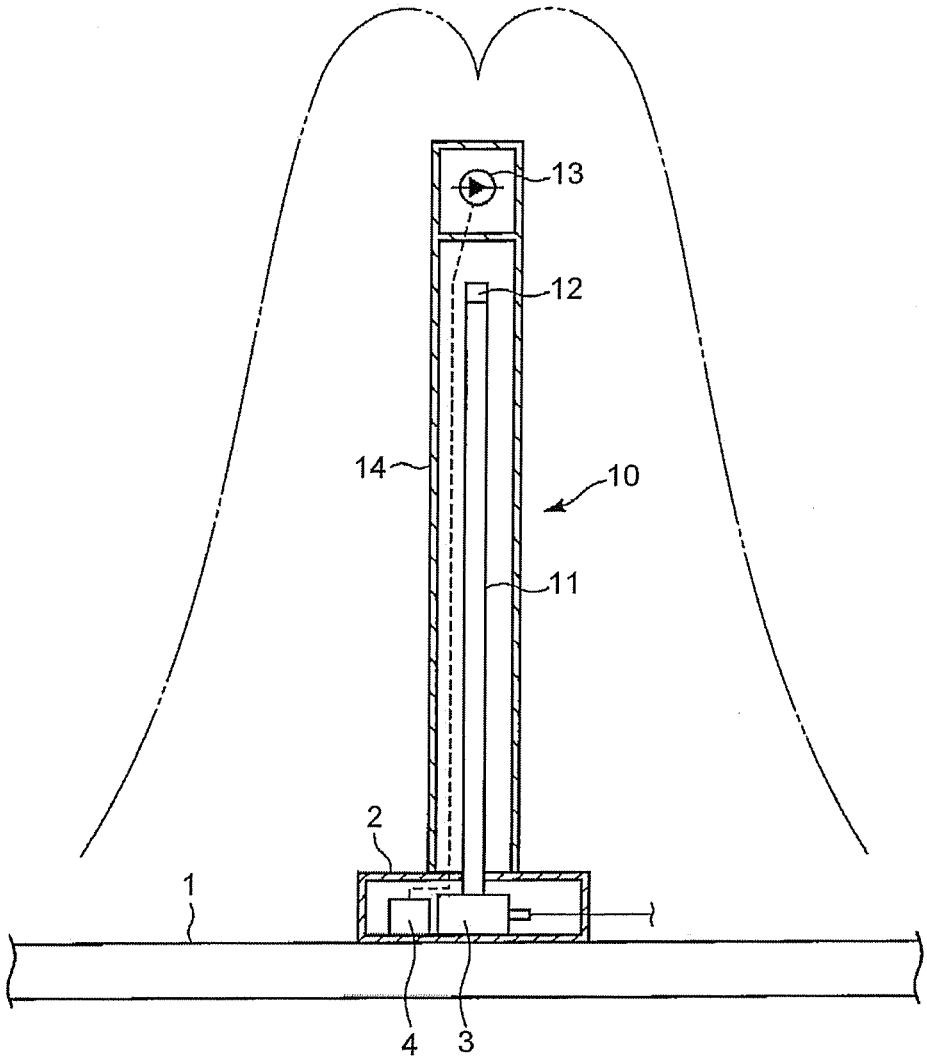
FIG. 1 is a part view showing a construction of the embodiments.

As shown in FIG. 1, a base (also called stand) 2 is installed on an attaching plane 1 such as a floor, a ceiling, a table etc., and a tower-shaped antenna 10 is stood on the base 2. The antenna 10 consists of a leaky coaxial cable 11 that leaks the radio wave, and a terminator 12 arranged at a distal end of the leaky coaxial cable 11, an indicator 13 i.e. a unit that informs the presence or absence of the radiation of the radio wave, and a cylindrical cover 14 that covers these components.

The leaky coaxial cable 11, also called LCX cable, comprises multiple slots for leaking the radio wave along the axial direction. Due to the radio wave leaked from the leaky coaxial cable 11, a wireless LAN area so-called free-spot (also called service area) shown by a two-dot chain line is formed around the antenna 10. Within the free-spot, anyone can freely conduct a wireless communication by using a wireless communication terminal.

The above-mentioned base 2 not only supports the antenna 10 but also houses an access point (power supply unit) 3 and a power supply unit 4. The access point 3 supplies high-frequency electricity to the leaky coaxial cable 11. The power supply unit 4 delivers an operating voltage (DC voltage) to the above-mentioned indicator 13. In addition, the base 2 is metal-made and functions as a shielding member that shields the radio wave released from the access point 3.

The above-mentioned indicator 13 is a light-emitting diode (LED) arranged at the top of the antenna 10, when a power is supplied to the leaky coaxial cable 11 the indicator 13 emits light by providing an operating voltage from the above-mentioned power supply 4, and when the powder is not provided to the leaky coaxial cable 11 the indicator 13 quenches by shutting off the operating voltage from the above-mentioned power supply 4.

Figure 2:
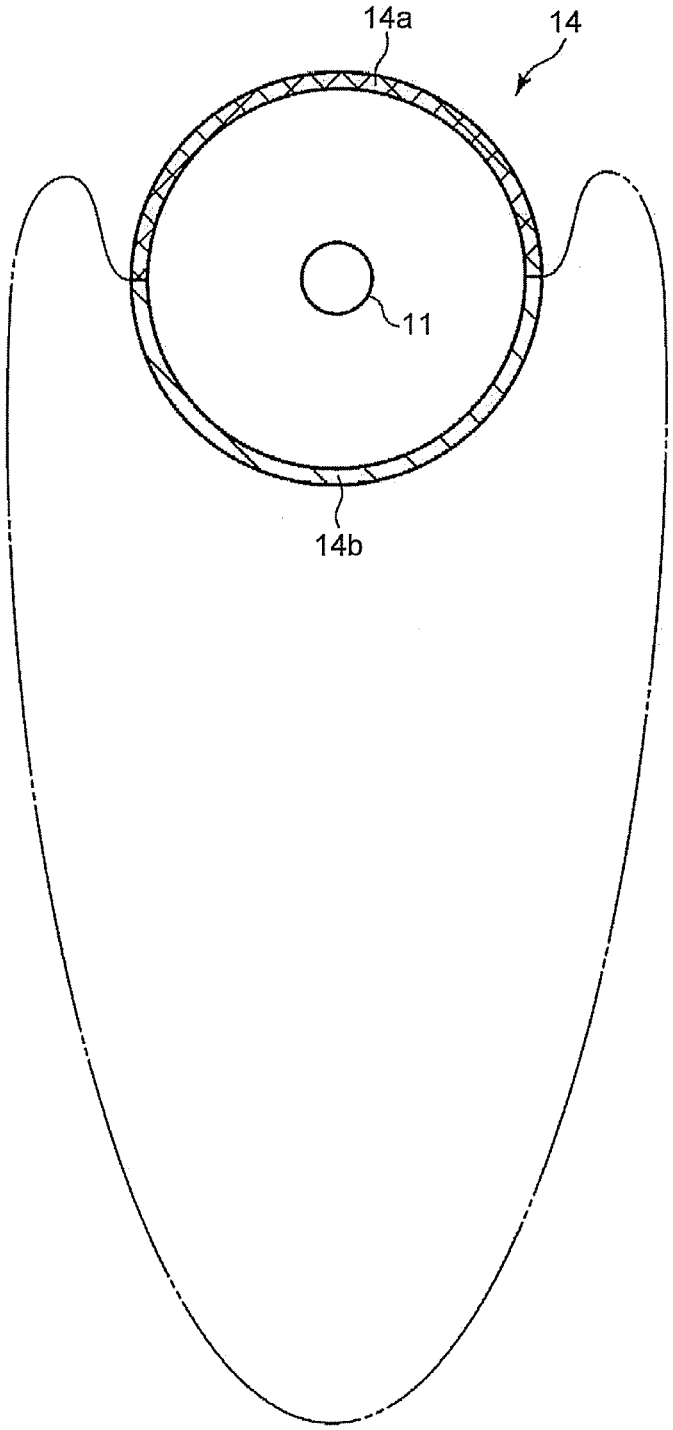
FIG. 2 is a vertical view of a construction of a cover and radiation of a radio wave in a first embodiment.

For the above-mentioned cover 14, as shown in FIG. 2, the region being nearly half of it along the circumferential direction of the leaky coaxial cable 11 is a metal-made portion 14*a*, and the remaining region is a non-metal-made portion 14*b*. The metal-made portion 14*a* functions as a reflective member that reflects the radio wave leaked from the leaky coaxial cable 11 in a direction perpendicular to the axial direction of the leaky coaxial cable 11. The non-metal-made portion 14*b* permits the passage of the radio wave leaked from the leaky coaxial cable 11.

In other words, the radio wave leaked from the leaky coaxial cable 11 directly passes through the non-metal-made portion 14*b* and is radiated, meanwhile it is reflected by the metal-made portion 14*a* then passes through the non-metal-made portion 14*b* and is radiated. Thus, at the side of the metal-made portion 14*a* the radio wave is not radiated, and at the side of the non-metal-made portion 14*b* the radio wave is strongly radiated. Therefore, a wireless LAN area (the free-spot) with directivity is formed.

In case that the antenna 10 is installed at a window, a wall and a room corner etc., by directing the metal-made portion 14*a* side of the cover 14 towards the window or the wall, an useless spread of the radio wave towards the window or the wall is minimized, meanwhile a wireless LAN area with good communication efficiency is formed at the side of the user.

The access point 3 is housed in the metal-made base 2, and the radio wave released from the access point 3 is shielded, therefore the influence by the radio wave released from the access point 3 is avoided, and the directivity of the wireless LAN area can be set to an optimal condition.

Figure 3:
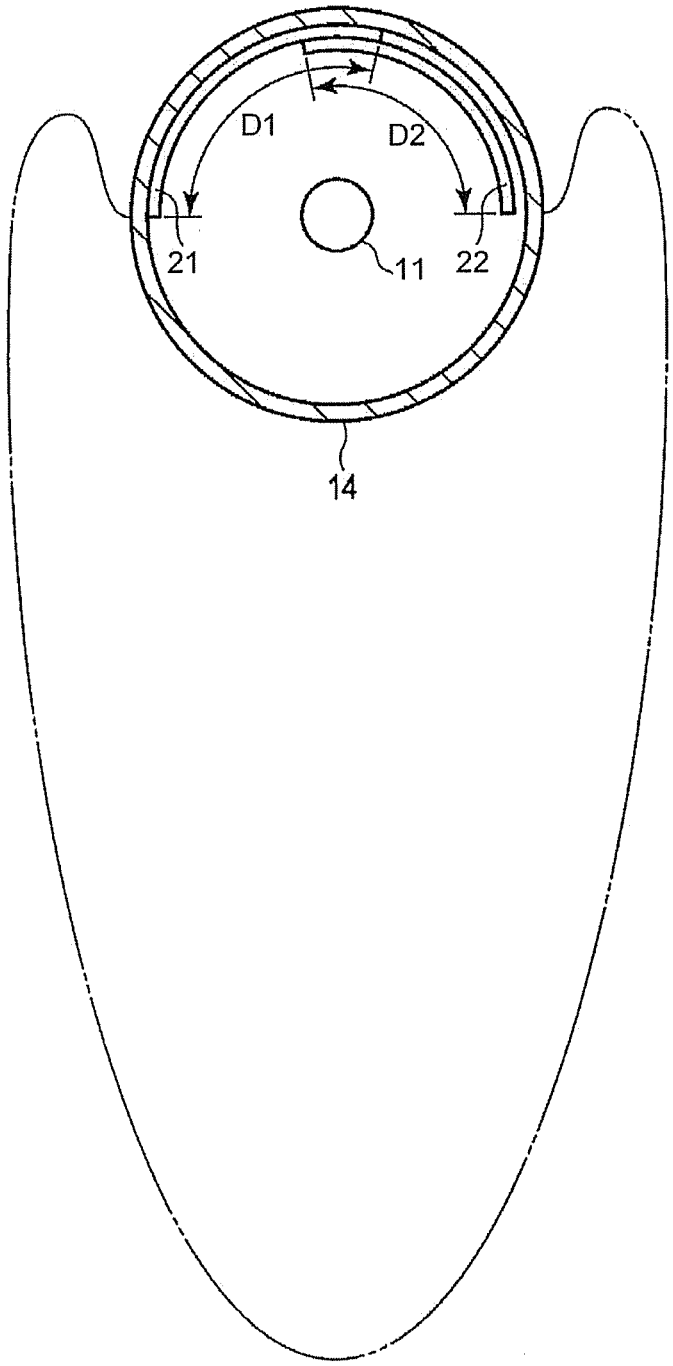
FIG. 3 is a vertical view of a construction of reflective boards and a radiation of a radio wave in a second embodiment.
Figure 4:
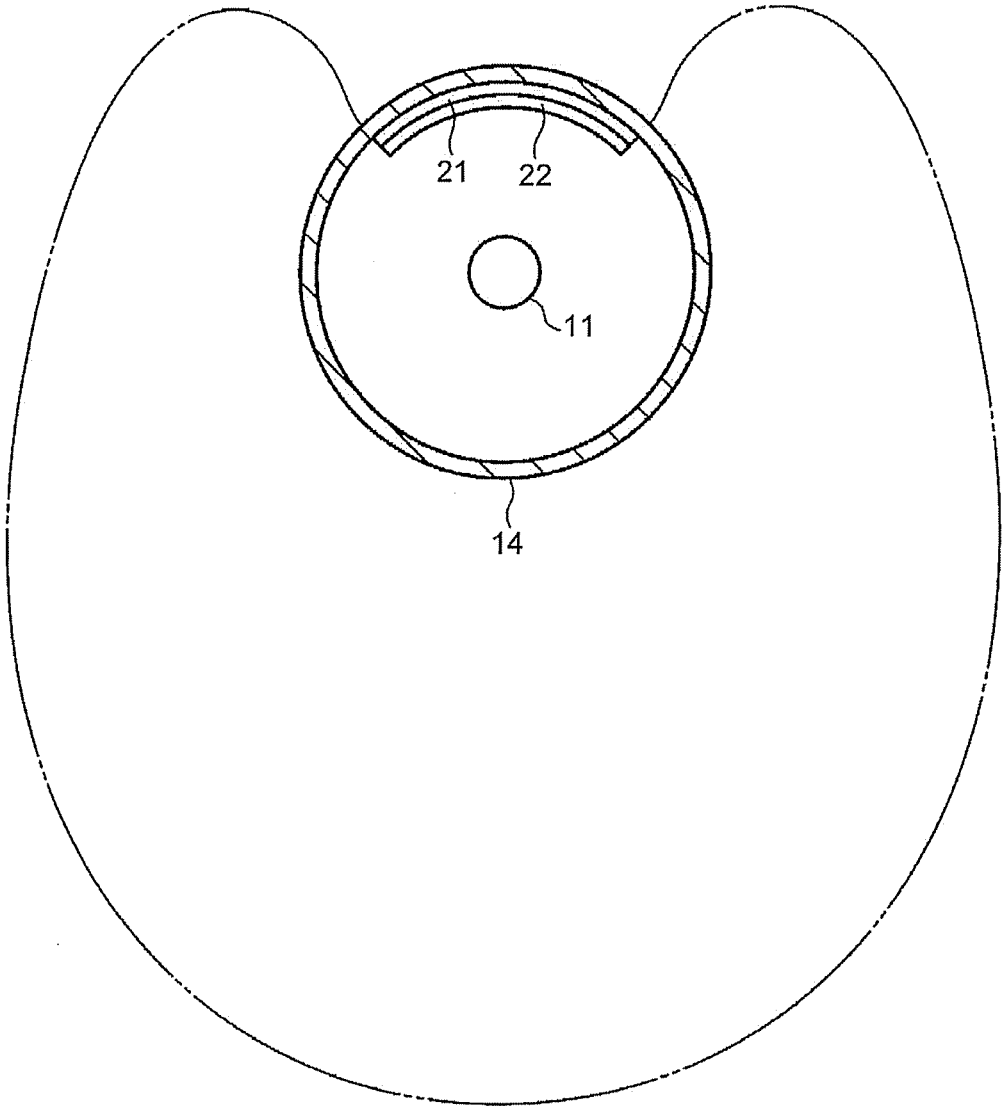
FIG. 4 is a vertical view of a movement of the reflective boards and the radiation of the radio wave in FIG. 3.
Figure 5:
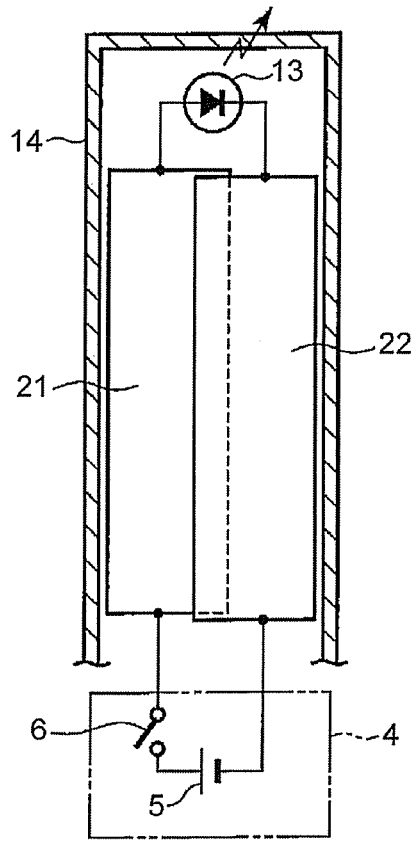
FIG. 5 is a drawing of an energizing path in the second embodiment.

(2) The second embodiment will be illustrated via FIG. 3-FIG. 5. In addition, in the drawings the same portion as the first embodiment is given the same sign, and its description is omitted.

All the cover 14 is formed by the non-metal-made member. Then, as shown in FIG. 3, within the cover 14 the multiple metal-made reflective boards 21, 22 used as the reflective members are housed in a region corresponding to approximately half of the inner periphery of the cover 14. These reflective boards 21, 22 have curved shapes along a inner periphery of the cover 14, meanwhile have width dimensions D1, D2 slightly larger than ¼ of the whole circumference of the cover 14, and have approximately the same longitudinal dimension as the axial length of the leaky coaxial cable 11.

A part of these reflective boards 21, 22 overlap with each other, and the reflective boards 21, 22 are movable along the circumferential direction of the leaky coaxial cable 11 (=the circumferential direction of the cover 14). Due to this movement, the area of the reflective region against the radio wave leaked from the leaky coaxial cable 11 can be increased or decreased.

As shown in FIG. 3, if the reflective boards 21, 22 expand with each other in a separation direction, the area of the reflective region formed at the front of the reflective boards 21, 22 becomes greater. In this case, the radio wave leaked from the leaky coaxial cable 11 directly passes through the cover 14 and is radiated, meanwhile it is reflected at the front of the reflective board 21, 22 and passes through the cover 14 and radiated. Therefore, the radio wave is not radiated at the backside of the reflective boards 21, 22, and the radio wave is strongly radiated towards the side to which the front surface of the reflective boards 21, 22 are facing. Therefore, the wireless LAN area (the free-spot) with directivity is formed.

As shown in FIG. 4, if the reflective boards 21, 22 overlap against each other, then the area of the reflective region formed at the front of the reflective boards 21, 22 becomes smaller. In this case, the wireless LAN area has directivity and becomes wider.

In case that the antenna 10 is installed at the window, the wall, the room corner etc., the side of the reflective boards 21, 22 is directed towards the window or the wall, thereby the useless spread of the radio wave towards the side of the window or the wall is minimized, meanwhile a wireless LAN area with good communication efficiency is formed at the side of the user. Furthermore, the area of the reflective region of the reflective boards 21, 22 can be adjusted, thus the dimension of the wireless LAN area can be set to an optimal condition according to the utilization situation such as the location of the user or the number of users etc.

The access point 3 is housed in the metal-made base 2, and the radio wave released from the access point 3 is shielded, therefore the influence by the radio wave released from the access point 3 is avoided, and the directivity of the wireless LAN area can be set to an optimal condition.

On the other hand, as shown in FIG. 5, the power supply unit 4 within the base 2 comprises a DC power supply 5 that delivers an operating voltage (DC voltage) for the indicator 13, and a switch 6. The switch 6 is on when a powder is supplied to the leaky coaxial cable 11 from the access point 3, and it is off when the powder is not supplied.

One end of the indicator 13 is connected to a positive terminal of the DC power supply 5 via the switch 6 and the reflective board 21, and the other end of the indicator 13 is connected to a negative terminal of the DC power supply 5 via the reflective board 22. In addition, the overlapping portion of the reflective boards 21, 22, for example, is coated with inslative resin or paint, thereby becoming to an insulated condition with each other.

If the switch 6 is on when a power is supplied to the access point 3 from the leaky coaxial cable 11, then the voltage from the DC power supply 5 is applied to the indicator 13 via the switch 6 and the reflective board 21, 22. In this way, the indicator 13 emits a light, and the user is informed that the wireless communication area is under an operating condition. If the switch 6 is off when the power is not supplied from the access point 3, then the voltage supply for the indicator 13 is shut off. In this way, the indicator 13 quenches, and the user is informed that the wireless communication area is under a non-operating condition.

In this way, the metal-made reflective boards 21, 22 are also used as the energizing paths for the indicator 13, so it is not necessary to lay a signal wire for voltage application within the case 14. Thus, the simplification of construction is achieved meanwhile the cost reduction is achieved.

(3) The third embodiment will be illustrated. In addition, in the drawings the same portion as the first embodiment is given the same sign, and its description is omitted.

Figure 6:
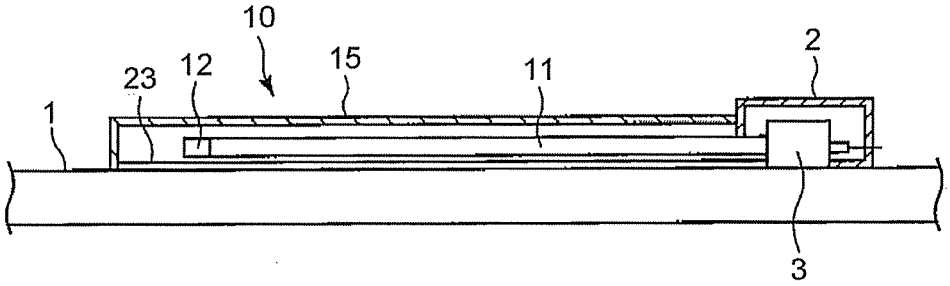
FIG. 6 is a part view showing a construction of a third embodiment.

As shown in FIG. 6, the leaky coaxial cable 11 is arranged parallel to the attaching plane 1, and a reflective board (reflective member) 23 is arranged between the leaky coaxial cable 11 and the attaching plane 1. The reflective board 23 reflects the radio wave leaked from the leaky coaxial cable 11 towards the side of the leaky coaxial cable 11. Then, the leaky coaxial cable 11 and the reflective board 23 are covered by a molded case 15. The molded case 15 is an alternative to the cover 14 of the first and second embodiments.

According to such construction, the useless spread of the radio wave to the side of the attaching plane 1 is minimized, meanwhile a wireless LAN area with good communication efficiency is formed at the side of the user.

In addition, the embodiments are presented as examples and are not intended to limit the scope of the invention. The new embodiments can be implemented in other various embodiments. Various omissions, alterations, and modifications can be made without deviating from the gist of the invention. These embodiments or their variations are included in the scope of the invention, and included in the invention described in the claims and its equivalent.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A wireless communication system, comprising:

a tower-shaped antenna includes a leaky coaxial cable that leaks a radio wave, wherein the antenna includes a cylindrical cover that covers the leaky coaxial cable;

a reflective member that reflects the radio wave leaked from the leaky coaxial cable in the direction perpendicular to an axial direction of the leaky coaxial cable, wherein the reflective member includes a multiple reflective boards which are movable along a circumferential direction of the leaky coaxial cable and housed in the cylindrical cover;

an indicator arranged at the top of the antenna; and a power source which is arranged at a base end part of the antenna and supplies a drive voltage to the indicator, wherein the reflective boards functions as energizing paths between the power source and the indicator.

2. The wireless communication system according to claim 1, wherein the reflective member is metal-made portions that form a part of the cover.

3. The wireless communication system according to claim 1, further comprising:

a metal-made base that supports the antenna and houses the power source.

* * * * *